US005191920A

United States Patent [19]

McGregor

[11] Patent Number: 5,191,920

[45] Date of Patent: Mar. 9, 1993

[54] Z-BELT TYPE LIFTING AND STABILIZING MECHANISM FOR VERTICAL BAG FILLING MACHINES

[76] Inventor: Harold R. McGregor, 645 Riverwood Dr., Owatonna, Minn. 55060

[21] Appl. No.: 694,457

[22] Filed: May 1, 1991

[51] Int. Cl.[5] ..... B66B 11/04; B65B 1/04

[52] U.S. Cl. ..... 141/313; 141/114; 141/253; 141/275; 187/19

[58] Field of Search ..... 141/10, 114, 313-317, 141/253, 256, 275, 276; 187/19, 20

[56] References Cited

U.S. PATENT DOCUMENTS

| | | | |
|---|---|---|---|
| 29,180 | 7/1860 | Lemman | 187/19 |
| 670,929 | 4/1901 | Feder | 187/19 X |
| 3,112,777 | 12/1963 | Lohse | 141/316 X |
| 3,232,455 | 2/1966 | Fountain et al. | 187/19 X |
| 3,313,376 | 4/1967 | Holland, Sr. | 187/19 X |
| 3,651,838 | 3/1972 | Albert | 141/284 |
| 4,168,728 | 9/1979 | Sayers et al. | 141/284 |
| 4,440,266 | 4/1984 | Kohler | 187/19 X |
| 4,455,115 | 6/1984 | Alger et al. | 187/20 X |
| 4,467,845 | 8/1984 | Strand et al. | 141/10 |
| 4,566,561 | 1/1986 | Atkey | 187/20 |
| 5,036,954 | 8/1991 | Haahtikivi et al. | 187/20 X |
| 5,042,539 | 8/1991 | McGregor | 141/114 |

FOREIGN PATENT DOCUMENTS

| | | | |
|---|---|---|---|
| 0250989 | 1/1961 | Australia | 187/19 |
| 0827974 | 11/1969 | Canada | 187/19 |
| 0158331 | 3/1957 | Sweden | 187/19 |
| 0008868 | of 1900 | United Kingdom | 187/19 |

*Primary Examiner*—Henry J. Recla
*Assistant Examiner*—Casey Jacyna
*Attorney, Agent, or Firm*—Moore & Hansen

[57] ABSTRACT

A lifting and stabilizing mechanism for an apparatus such as a bag elevator assembly for an automated filling machine having a stationary frame and a generally horizontal carriage mounted for vertical movement relative to the frame. The carriage is carried on a plurality of geared belts which each criss-cross the frame in an opposing "Z" configuration, and are alternately wrapped over and under opposed drive wheels and tensioning wheels rotatably mounted on the carriage. The opposing belts maintain the carriage in its horizontal orientation, and the drive wheels are rotated to provide the lift force for controllably raising and lowering the carriage. The drive belts are attached to and extend along vertical brace members of the frame using one of various clamping assemblies, and the vertical alignment of the carriage is augmented by a pin and channel guide assembly. Exact vertical linear registration or displacement of the carriage is accomplished by monitoring the revolutions of the drive wheels, drive axle, or drive motor, and comparing those revolutions to a predetermined chart or formula relating revolutions to linear displacement.

46 Claims, 7 Drawing Sheets

Z-BELT TYPE LIFTING AND STABILIZING MECHANISM FOR VERTICAL BAG FILLING MACHINES

BACKGROUND OF THE INVENTION

This invention relates generally to lifting and stabilizing apparatuses for vertical auger type bag filling machines, and particularly to a mechanism employing opposing Z-belts.

Lifting and stabilizing mechanisms for automated bag filling equipment, alternately referred to as bag elevator assemblies, are know to the art. Existing lifting and stabilizing mechanisms usually comprise vertical tracks on which carriages travel, the tracks having beveled edges which engage grooved guide wheels on the carriage, or vice versa. The carriages are generally lifted and lowered using a combination of one or more drive gears and chains, servos, or dual acting power cylinders. A representative example of such a mechanism as described above may be seen in U.S. Pat. No. 4,944,334 and its related applications.

These lifting and stabilizing mechanisms are used to control the raising and lowering of bag handling mechanisms, including bag gripping and hanging mechanisms for mounting and holding a bag on a fill spout, and mechanisms for moving that bag relative to a fill tube or fill spout during filling by a filling machine such as a vertical auger bag filler. These lifting and stabilizing mechanisms may also be utilized to carry bag tamping or settling mechanisms, net weigh scales, and additional equipment or controls.

In order to ensure proper vertical alignment and uniform horizontal orientation, the configuration of conventional lifting and stabilizing mechanisms generally require very heavy and bulky assemblies. The increase in size and weight of the mechanisms requires proportionately higher capacity drives in order to controllably lift and lower the mechanisms at the speeds required by automated fill systems, and proportionately larger areas in which the machines are placed. In a system for filling fifteen 100 lbs. bags per minute with a powdered product, for example, the lifting and stabilizing mechanism might account for ten to twenty times the weight of the filled bag. Consequently, the mechanism is far more difficult to tune, requires heavier duty and more expensive components to endure prolonged usage, requires more complicated controls and regulating mechanisms to ensure accuracy and uniformity over extended periods, and generally consume more energy and are less efficient than lighter and smaller mechanisms. The size of these mechanisms can also affect the ability to integrate other devices, such as bag infeed or hanging mechanisms, release and conveyor assemblies, weigh scales, vacuum systems or de-aeration mechanisms, and safety or control devices.

BRIEF SUMMARY OF THE INVENTION

It is one therefore object of this invention to design a lifting and stabilizing mechanism for use with an automated bag filling machine such as a vetical auger which provides extremely accurate and uniform vertical alignment and horizontal orientation for a bag handling carriage or similar system.

It is another object of this invention to design the above lifting and stabilizing mechanism such that it can be operated at extremely high speed while maintaining both accurate vertical linear registration and a precise incremental control over the rate of vertical movement in the upward and downward directions.

It is an additional object of this invention to design the above lifting and stabilizing mechanism such that it is smaller and lighter weight than conventional assemblies, thereby consuming less energy in operation, and permitting a wider range of operating environments and configurations.

It is a related object of this invention to minimize and integrate the operational functions of the above lifting and stabilizing mechanism to require fewer regulating mechanisms, controls, and drive mechanisms.

It is yet another object of this invention to design the above lifting and stabilizing mechanism to minimize wear on components, and to provide a system wherein worn components can be easily detected and replaced without disassembling the apparatus or removing the apparatus from the associated automated filling machine.

Briefly described, the lifting and stabilizing mechanism of this invention incorporates a stationary frame and a generally horizontal carriage mounted for vertical movement relative to the frame. The carriage is carried on a plurality of geared belts which each criss-cross the frame in an opposing "Z" configuration, and are alternately wrapped over and under opposed drive wheels and tensioning wheels mounted on the carriage. The opposing belts maintain the carriage in its horizontal orientation, and the drive wheels are rotated to provide the lift force for controllably raising and lowering the carriage. The drive belts are attached to the frame using one of various clamping assemblies, and the vertical alignment of the carriage is augmented by a pin and channel guide assembly. Exact vertical linear registration o displacement of the carriage frame is accomplished by monitoring the revolutions of the drive wheels, drive axle, or drive motor, and comparing those revolutions to a predetermined chart or formula relating revolutions to linear displacement. One example of this lifting and stabilizing mechanism permits vertically registered movement of a five hundred pound carriage and bag hanging assembly over a five foot lift path in less than three quarters of a second.

DESCRIPTION OF THE PREFERRED EMBODIMENTS

The Z-belt lifting and stabilizing mechanism of this invention is shown in FIGS. 1–15 and referenced generally therein by the numeral 10.

Figure 1:
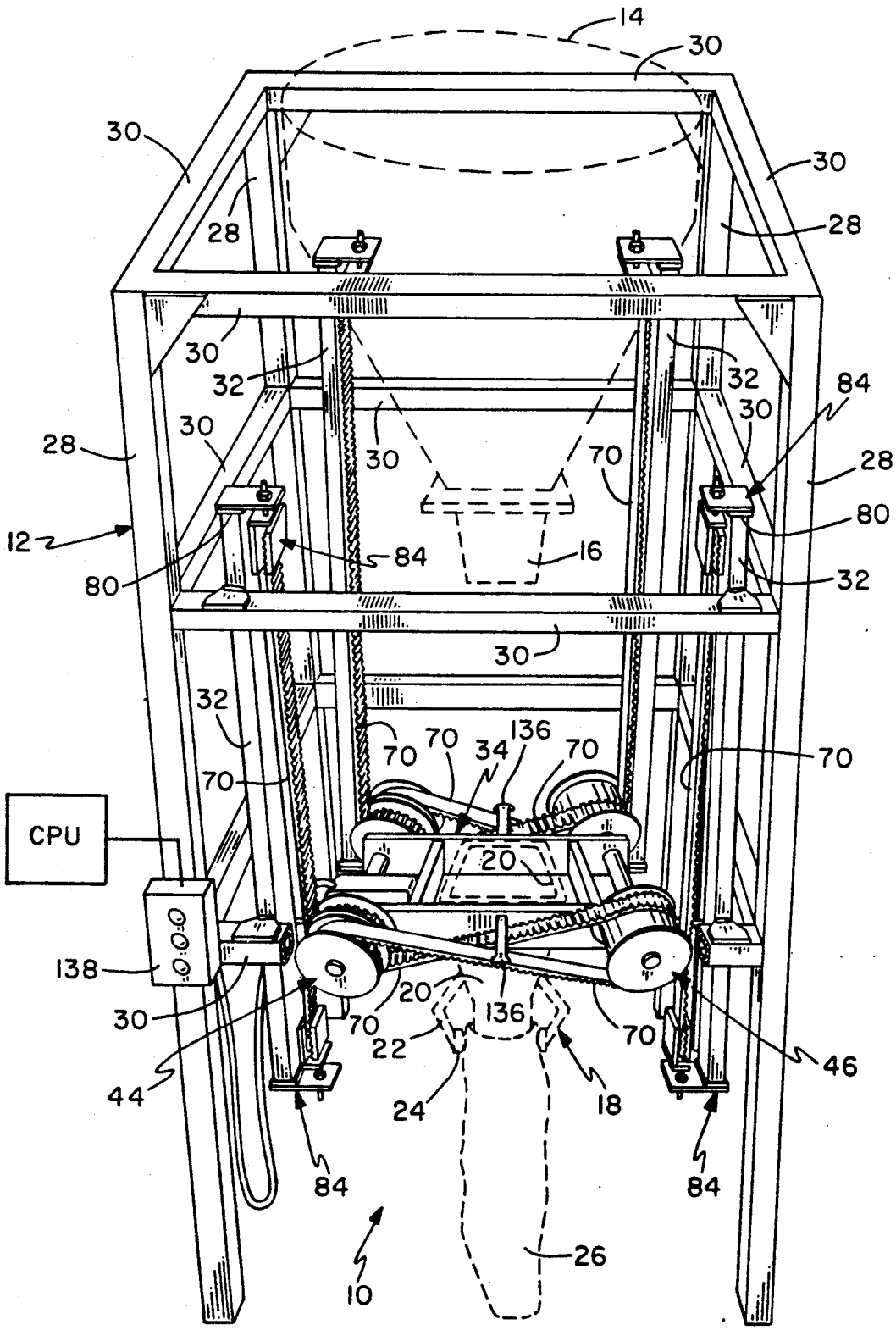
FIG. 1 is a perspective view from above of the Z-belt lifting and stabilizing mechanism of this invention.

Referring particularly to FIG. 1, the Z-belt mechanism 10 is shown mounted within a frame 12 which also supports any conventional type automated bag filling machine having a hopper or auger bowl 14 from which a fill tube 16 depends. The Z-belt mechanism 10 carries the components of an automated bag gripping and hanging mechanism 18 including a clam-jaw type fill spout 20, bag hanging arms 22 having bag gripping members 24, as well as the appropriate type of bag 26 for use with the product to be filled by the automated bag filling machine.

Representative examples of the components of such an automated bag filling machine, including the auger bowl 14, fill tube 16, spout 20, bag hanging arms 22, and bag gripping members 24, may are shown in U.S. Pat. Nos. 4,322,932; 4,432,186; 4,612,965; and the above referenced 4,944,334.

Referring again to FIG. 1, the frame 12 is seen to consist of a plurality of vertical beams 28 and horizontal beams 30. Mounted within the frame 12 in generally vertical alignment are four generally vertical brace members 32, each brace member 32 being disposed in one of the four corners of the frame 12 such that each of two pairs of the brace members 32 face one other and are spaced apart on opposing sides of the auger bowl 14 and spout 16.

The automated bag gripping and hanging mechanism 18 is disposed beneath the spout 16 with the lower spout shroud 20 being attached to and carried on a carriage frame 34, the carriage frame 34 having a pair of spaced-apart side members 36 and cross members 38 extending between and connecting the side members 36. The carriage frame 34 is positioned so as to be generally centered between the front and back pair of brace members 32 as shown in FIG. 1, the opposing ends of each of the side members 36 extending to a point closely proximate to the inner surface 40 of each of the left and right side pair of brace members 32. In some applications, the opposing ends of the side members 36 may extend beyond the inner surface 40 of the brace members 32 or beyond the brace members 32 themselves, so long as the frame 12 or other components of the Z-belt mechanism 10 do not obstruct the vertical movement of the carriage frame 34.

Extending between and mounted on the side members 36 are a pair of axles 42, each axle 42 being mounted for rotational movement about an axis of rotation relative to the side members 36. Each axle 42 is received through a pair of corresponding aligned apertures in the side members 36, although the axles 42 may alternately be mounted and carried either above or below the side members 36.

Removably connected to and mounted on each opposing end of each of the axles 42 are a pair of drive wheel assemblies 44 or a tensioning wheel assembly 46.

Figure 3:
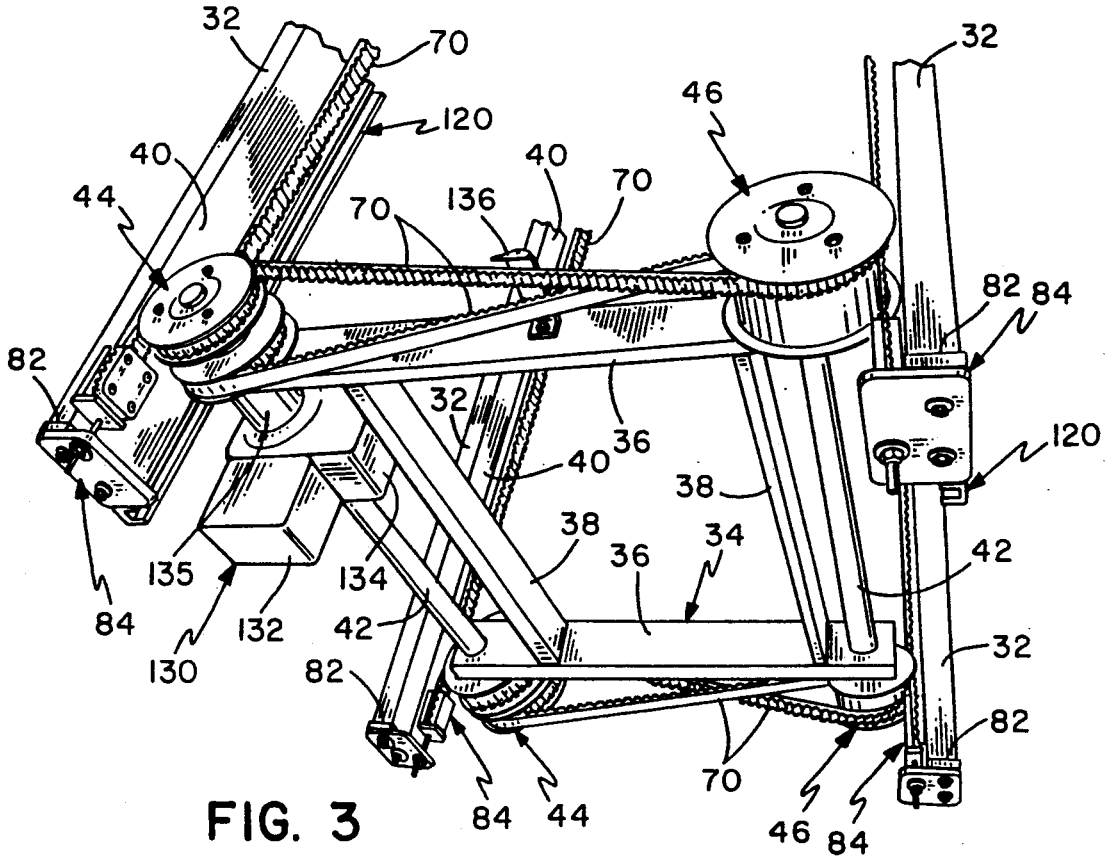
FIG. 3 is is a perspective view from below of the Z-belt mechanism of FIG. 1.
Figure 10:
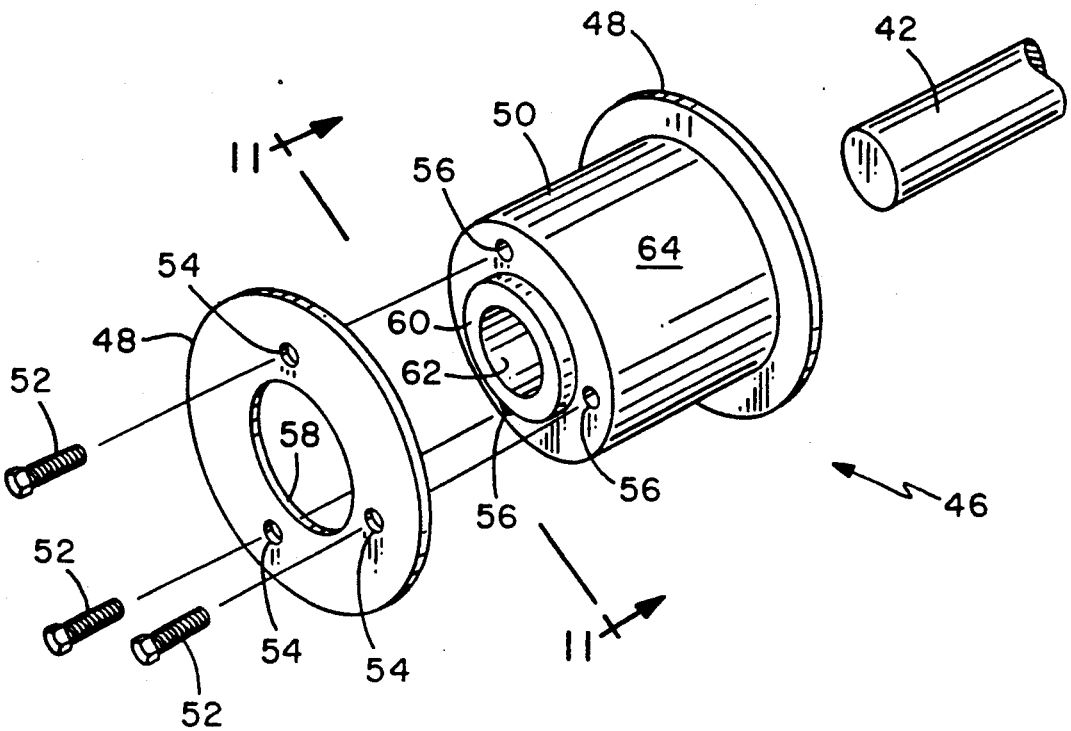
FIG. 10 is an exploded view of a tensioning wheel assembly of the Z-belt mechanism of FIG. 1.
Figure 11:
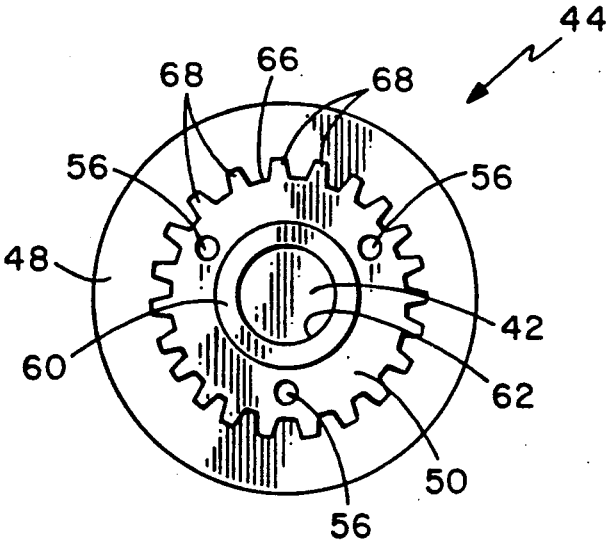
FIG. 11 is a side cross section view of a drive wheel assembly of the Z-belt mechanism of FIG. 1, taken from the viewpoint of line 11—11 in FIG. 10.

Referring to FIGS. 3, 10, and 11, it may be seen that each wheel assembly 44, 46 is constructed from a pair of thin, generally circular spaced-apart flange members 48 each having a larger diameter, with a generally circular center hub 50 of smaller diameter than the flange members 48 disposed between the flange members 48. The flange members 48 and center hub 50 are fastened together in any conventional manner such as by a plurality of threaded fasteners 52 which extend through apertures 54 in each o the flange members 48 and corresponding apertures 56 in the center hub 50, with a central opening 58 in each flange member 48 being aligned with and received on one of a pair of recessed grooves or extensions 60 on opposing sides of the center hub 48. The center hub 50 of each wheel assembly 44, 46 further defines a central bore 62 to slidably receive a portion of the axle 42 when the wheel assembly 44, 46 is mounted thereon, each wheel assembly 44, 46 being slidably received and keyed or locked to the corresponding axle 42 using conventional means such as a threaded fastener such that each wheel assembly 44, 46 rotates in unison with the corresponding axle 42 at the same angular rate of revolution.

Referring to FIG. 10, it may be seen that the outer cylindrical surface 64 of the center hub 50 of each tensioning wheel assembly 46 is generally smooth. Conversely, the outer surface 66 of the center hub 50 of each drive wheel assembly 44 defines a plurality of wide drive gear teeth 68. The center hub 50 of each tensioning wheel assembly 46 must have a width equal to the width of two drive wheel assemblies 44 plus the norma spacing between the two drive wheel assemblies 44 when mounted upon the axle 42 in order to permit proper alignment of the drive wheel assemblies 44 and opposing tensioning wheel assembly 46. While a pair of single tensioning wheel assemblies 46 have been shown herein with one tensioning wheel assembly 46 disposed on each one of the opposing sides of the carriage frame 34, it should be understood that a pair of tensioning wheel assemblies 46 sized similarly to the drive wheel assemblies 44 may be utilized on each side of the carriage frame 34 for a total of four tensioning wheel assemblies 46.

Referring again to FIGS. 1 and 3, it may be seen that two drive wheel assemblies 44 are disposed on each of the opposing ends of one axle 42, while a single tensioning wheel assembly 46 is disposed on each of the ends of the opposing axle 42. Each set of two drive wheel assemblies 44 is positioned on the exterior side of the adjacent side member 36 of the carriage frame 34, and each drive wheel assembly 44 is aligned with a portion of the corresponding tensioning wheel assembly 46 disposed on the opposing axle 42 and similarly positioned on the exterior side of the adjacent side member 36 of the carriage frame 34.

Figure 2:
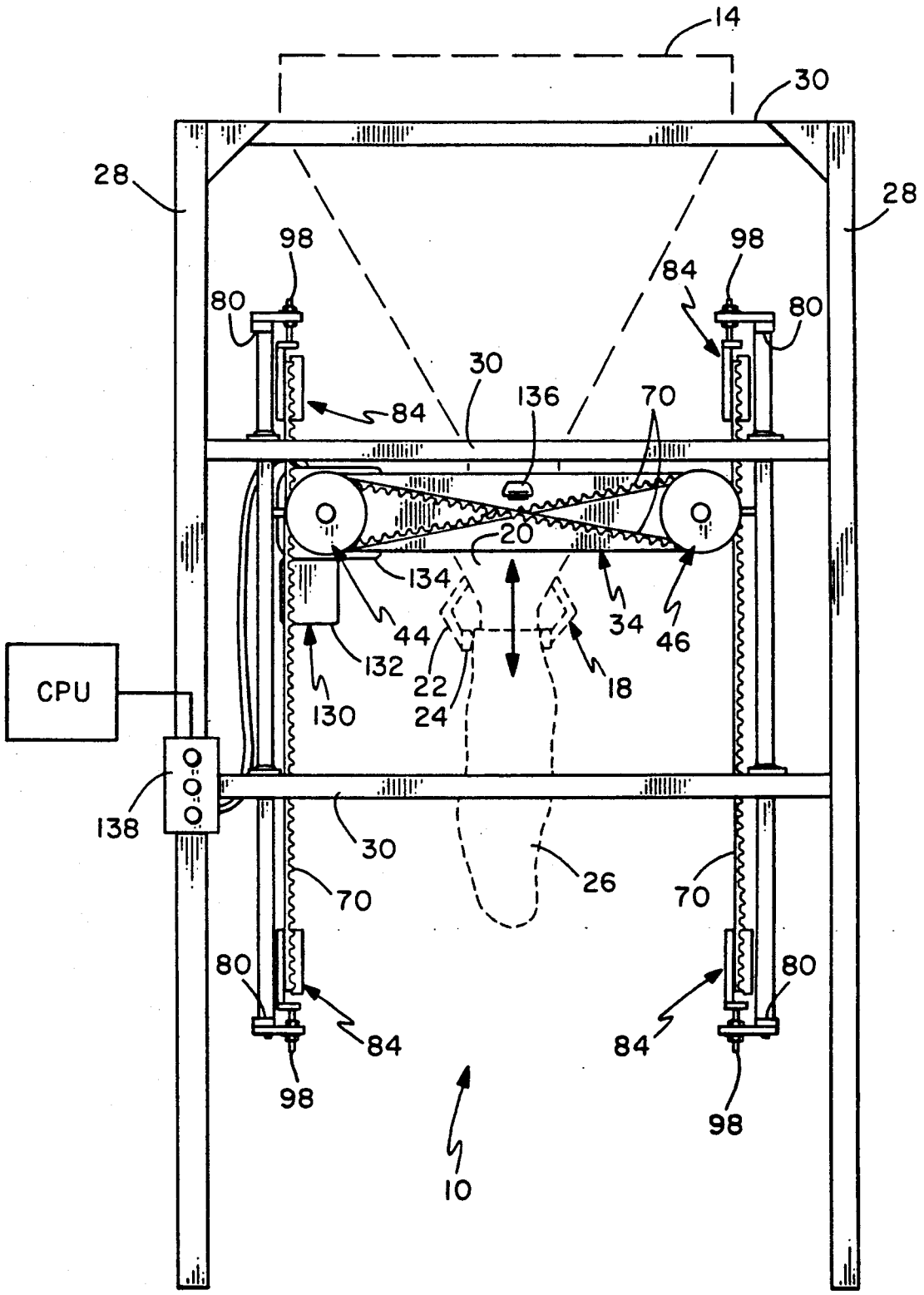
FIG. 2 is a side elevation view of the Z-belt mechanism of FIG. 1.
Figure 7:
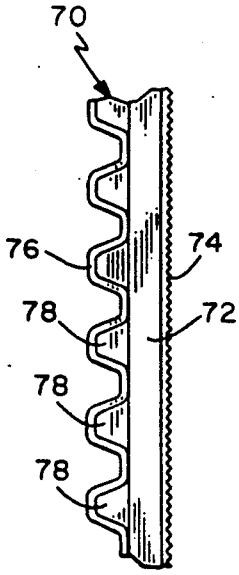
FIG. 7 is a side view of a section of the drive chain of the Z-belt mechanism of FIG. 1.

A plurality of flexible Z-tracks, Z-chains, or Z-belts 70 are looped over and carried on the drive wheel assemblies 44 and tensioning wheel assemblies 46 as shown in FIGS. 1-3. Referring to FIG. 7, each Z-belt 70 is comprised of a length of steel-belt material 72 having a planar side 74 with a textured rubber or other friction-producing coating, and a drive side 76 having a multiplicity of belt teeth 78 corresponding in size, depth, and spacing to the drive gear teeth 68 on the center hubs 50 of the drive wheels assemblies 44. The drive side 76 of the Z-belts 70 are similarly coated with a textured rubber or other friction-producing coating.

Each Z-belt 70 has an approximate length sufficient to extend linearly between the top end 80 and the bottom end 82 of the brace members 32, plus the distance between two opposing brace members 32 at the front and back of the frame 12.

Referring particularly to FIGS. 1 and 3, a first Z-belt 70 is connected to one of the rear brace members 32 near the bottom end thereof by a clamping assembly 84, the end of the first Z-belt 70 and corresponding brace member 32 being most closely adjacent t a first one of the set of two drive wheel assemblies 44. The first Z-belt 70 is oriented such that the planar side 74 is facing the brace member 32 and spaced a short distance therefrom, and the belt teeth 78 of the drive side 76 of the first Z-belt 70 are facing the drive gear teeth 68 of the corresponding drive wheel assembly 44. The first Z-belt 70 extends upwardly from the clamping assembly 84 at the bottom end 82 of the brace member 32 and over the outer rear and top sides of the center hub 50 of the adjacent drive wheel assembly 44 between the flanges 48 thereof, forwardly and downwardly to the opposing aligned tensioning wheel assembly 46 around the bottom and outer front sides of the center hub 50 of the tensioning wheel assembly 46, and upwardly to the top end 80 of the front brace member 32. The end of the first Z-belt 70 is connected to the front brace member 32 near the top end 80 thereof by a similar clamping assembly 84.

A second Z-belt 70 is connected to the top end 80 of the rear brace member 32 to which the first Z-belt 70 is connected. The second Z-belt 70 extends downwardly from the top end 80 of the rear brace member 32 and around the outer rear and bottom sides of the center hub 50 of the second drive wheel assembly 44 adjacent the first drive wheel assembly 44 on which the first Z-belt 70 is carried. The second Z-belt 70 similarly extends forwardly but upwardly to the opposing aligned tensioning wheel assembly 46, around the top and outer front sides of the center hub 50 of the tensioning wheel assembly 46, and downwardly to the bottom end 82 of the front brace member 32. The end of the second Z-belt 70 is connected to the front brace member 32 near the bottom end 80 thereof by a clamping assembly 84.

As shown in FIGS. 1 and 3, the second Z-belt 70 and associated drive wheel assembly 44 and tensioning wheel assembly 46 are situated generally within a plane disposed between the adjacent side member 36 and a similar plane defined by the first Z-belt 70 and associated drive wheel assembly 44 and tensioning wheel assembly 46.

Referring again to FIGS. 1 and 3, third and fourth Z-belts 70, as well as their associated drive wheel assemblies 44 and tensioning wheel assembly 46, are positioned on the opposing side of the carriage frame 34 from the first and second Z-belts 70. Each of the third Z-belt 70 and and fourth Z-belt 70 is similarly situated in a plane along with their associated drive wheel assembly 44 and tensioning wheel assembly 46, with the orientation of the third and fourth Z-belts 70 being symmetric to the orientation of the first and second Z-belts 70 across a plane of reflection parallel to length of extent of the side members 36. In some applications, it may be desired that this orientation be reversed from the first and second Z-belts 70, or that orientation and position of one or all of the four Z-belts 70 be modified so as to be non-symmetric.

Referring to FIGS. 1-3 and 5-9, it may be seen that the clamping assemblies 84 provide a means to securely and engagingly fasten or secure each of the opposing ends of the Z-belts 70 to the upper or lower ends 80, 82 of the brace members 32, and to selectively adjust the longitudinal tension on those Z-belts 70.

Figure 5:
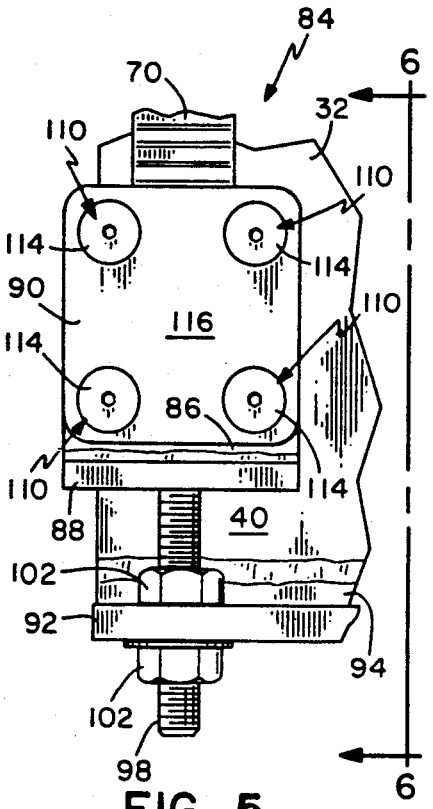
FIG. 5 is a front elevation view of one drive chain clamping assembly of the Z-belt mechanism of FIG. 1.
Figure 6:
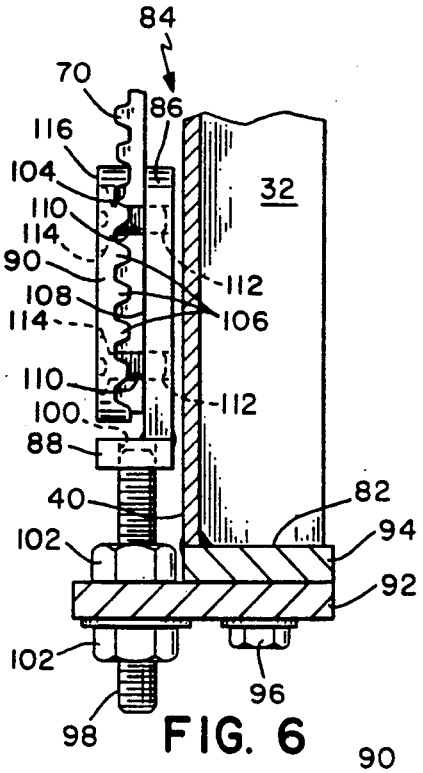
FIG. 6 is a partial cross section view of the drive chain clamping assembly of FIG. 5 taken from line 6—6 in FIG. 5.

Referring particularly to FIGS. 5 and 6, one embodiment of the clamping assembly 84 is shown, that clamping assembly 84 being one of the four clamping assemblies 84 positioned on the lower ends of the vertical brace members 32 from which the Z-belts 70 extend upwardly. In this embodiment of the clamping assembly 84, the Z-belt 70 is disposed between an L-shaped backing plate 86 having a projecting leg 88 fixedly attached to the lower end thereof, and a movable clamping plate 90 disposed a distance in front of the backing plate 86. The backing plate 86 is connected to the end of the vertical brace members 32 by an extension bracket 92 which is bolted or otherwise fastened to the end cap 94 of the brace members 32 using a threaded fastener 96. The extension bracket 92 extends forwardly or rearwardly from the front or rear face brace member 32, and defines an aperture through which a threaded tensioning fastener 98 is received. The upper end of the threaded tensioning fastener 98 is received in a threaded aperture 100 and secured to the 88 projecting leg 88 of the backing plate 86, or may alternately be fixedly attached to the projecting leg 88. The opposing lower end of the threaded tensioning fastener 98 is received through a correspondingly threaded aperture in the extension bracket 92, and fastened at a particular position or elevation relative thereto using a pair of correspondingly threaded hex nuts 102 or similar fastening devices. Rotation of the hex nuts 102, or rotation of the threaded tensioning fastener 98 relative to the hex nuts 102, will cause the threaded tensioning fastener 98 to move in a linear direction generally normal or perpendicular to the extension bracket 92, thereby tightening or loosening the Z-belt 70 by increasing or decreasing the tension applied thereto. Referring to FIG. 6, it may be seen that the inner surface 104 of the clamping plate 90 defines a plurality of horizontal grooves or teeth 106 which are sized and shaped to mesh with the belt teeth 78 on the drive side 76 of the Z-belt 70, while the inner surface 108 of the backing plate 86 may be smooth or have a roughened or knurled texture to provide additional friction between the backing plate 86 and the Z-belt 70. The end of the Z-belt 70 is secured between the clamping plate 90 and the backing plate 86 by a plurality of threaded clamping plate fasteners 110 which extend entirely through apertures in the clamping plate 90 perpendicular thereto and are disposed on opposing sides of the Z-belt 70. The clamping plate fasteners 110 are received within aligned apertures 112 in the backing plate 86, rotation of the clamping plate fasteners 110 forcefully urging the clamping plate 90 toward the backing plate 86 and into engaging and clamping contact with the Z-belt 70. The enlarged heads 114 of the clamping plate fasteners 110 are preferably flush with the outer surface 116 of the clamping plate 90, and may be tightened or loosened using a hex-key, Allen wrench, or similar tool. Similar clamping assemblies 84 may be utilized at the top ends of each of the brace members 32 and Z-belts 70, with the components of the clamping assemblies 84 being inverted across the horizontal axis.

In normal operation, sufficient longitudinal tension will be applied to each of the Z-belts 70 by the clamping assemblies 84, drive wheel assemblies 44, and tensioning wheel assemblies 46, such that the Z-belts 70 hold and constrain the carriage frame 34 in a predetermined orientation relative to horizontal. In most circumstances, this predetermined orientation will be near or exactly horizontal "level" as determined with relation to some portion of the carriage frame 34, with the criss-cross configuration of the Z-belts being used to establish and maintain the "level" horizontal orientation. Once the carriage frame 34 has been set to near-level, the threaded tensioning fasteners 98 of adjoining and opposing clamping assemblies 84 may be tightened or loosened (i.e., tightening the top clamping assembly 84 of one Z-belt 70 while loosening the bottom clamping assembly 84 securing the opposing longitudinal end of the same Z-belt 70) in unison to adjust the level or orientation of the carriage frame 34. By preventing rotation of the axle 42 and drive wheel assemblies 44 while tightening and loosening the corresponding ends of the Z-belts 70, the either side, end, or corner of the carriage frame 34 may be raised or lowered relative to one another to adjust the tilt or orientation of the carriage frame 34. Once set, the carriage frame 34 will maintain that set orientation as the carriage frame 34 is carried along the vertical path. Consequently, while a level horizontal orientation will be preferred in most applications, the carriage frame 34 may be set at some preferred angle, such as with one end raised or lowered relative to the opposing end, while the carriage frame 34 traverses the path.

Figure 6A:
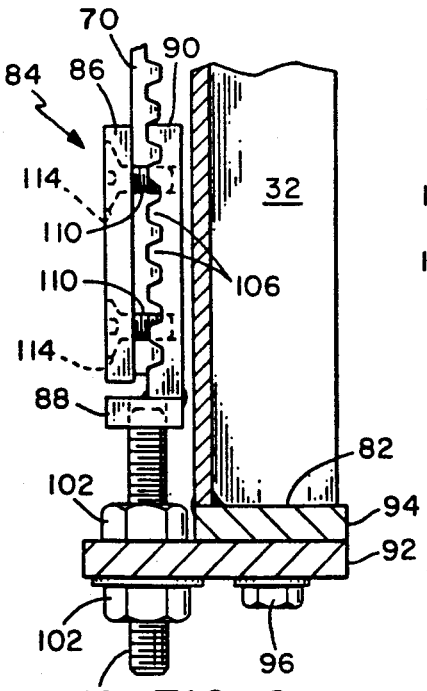
FIG. 6*a* is a partial cross section view of an alternate embodiment of the drive chain clamping assembly of FIG. 5 taken from line 6—6 in FIG. 5 showing the drive belt orientation reversed.

Referring to FIG. 6*a*, it may be seen that the the orientation of the drive side 76 and the planar side 74 of the Z-belt 70 relative to the brace member 32 may be reversed, so that the drive side 76 faces the adjacent brace member 32. In such a case, the backing plate 86 and clamping plate 90 may be rotated 180° or one half turn on the threaded tensioning fastener 98 so that the clamping plate 90 is disposed between the brace member 32 and the backing plate 86, with the clamping plate fasteners 110 extending entirely through the clamping plate 90 so that the heads 114 may be easily accessed without obstruction by the brace member 32. Alternately, as shown in FIG. 6*a*, the orientation of the backing plate 86 and clamping plate 90 may remain unchanged, but the inner surface of the backing plate 86 may define the plurality of teeth 106, and the inner surface of the clamping plate 90 may be generally planar or textured.

Figure 9:
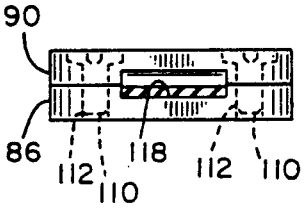
FIG. 9 is a top partial cross section view of the alternate embodiment of the drive chain clamping assembly of FIG. 8 taken from line 9—9 in FIG. 8.
Figure 8:
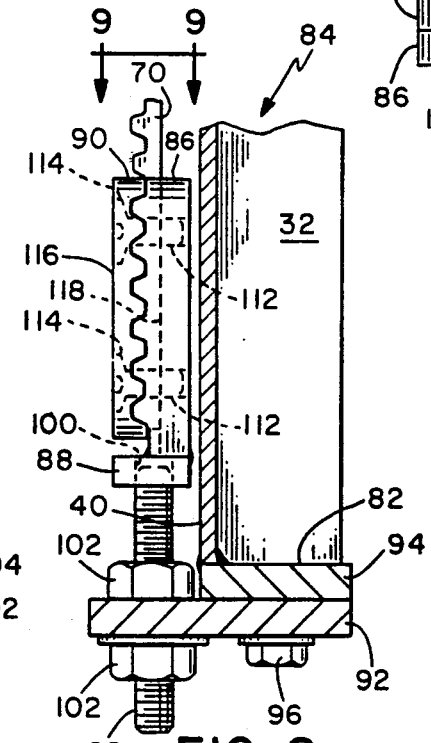
FIG. 8 is a partial cross section view of an alternate embodiment of the drive chain clamping assembly of FIG. 5 taken from line 6—6 in FIG. 5.

Referring to FIGS. 8 and 9, an additional alternative of the backing plate 86 and clamping plate 90 is shown, wherein one or both of the backing plate 86 and clamping plate 90 define a generally rectangular notch 118 of approximately the same width as the Z-belt 70, and communicating to form a recess having a depth approximately equal to the thickness of the Z-belt, whereby the backing plate 86 and clamping plate 90 may be forcibly urged near or into contact with one another by tightening the clamping plate fasteners 110.

The position of the first and second Z-belts 70 may be reversed or interchanged relative to one another, as well as the third and fourth Z-belts 70.

Figure 4:
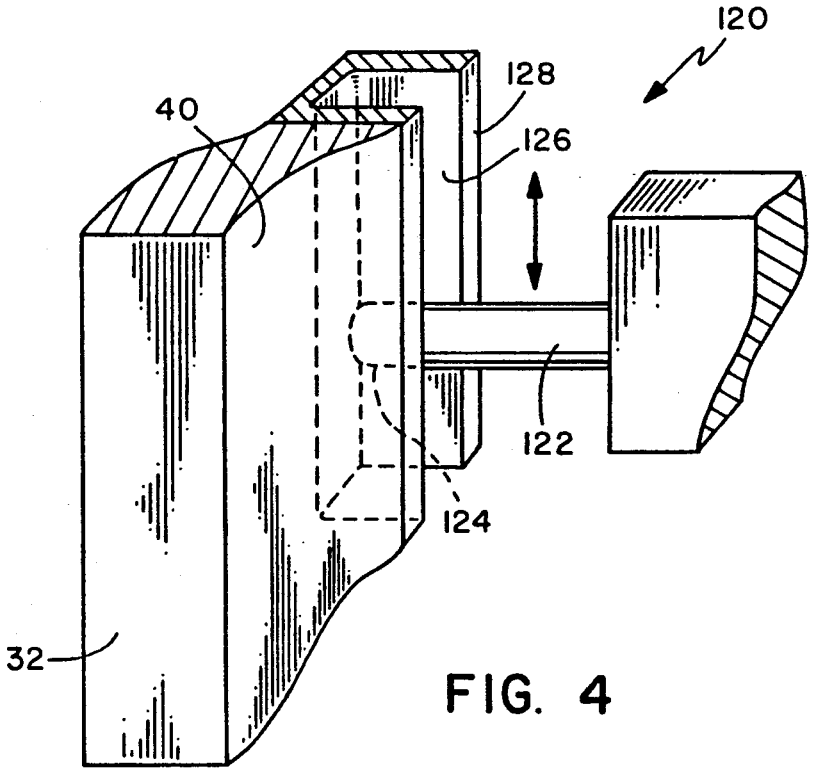
FIG. 4 is a perspective detail view of the pin and channel guide of the Z-belt mechanism of FIG. 1.

Referring particularly to FIGS. 3 and 4, it may be seen that the vertical alignment of the carriage frame 34 may be augmented by a pair of pin and channel guide assemblies 120 attached in opposition to one another on one side of the carriage frame 34. The pin and channel guide assemblies 120 include a pin 122 fixedly attached to and extending forwardly or rearwardly from the associated end of the side frame member 36 of the carriage frame 34, the distal end 124 of the pin 122 being received within a generally rectangular groove or notch 126 in a C- or U-shaped guide channel 128. Each of a pair of the guide channels 128 extend in generally vertical alignment along and connected to two of the vertical brace members 32, and are positioned and aligned to maintain a uniform vertical path for the carriage frame 34 and prevent rotation or twisting of the carriage frame 34 about a vertical or Z-axis.

Referring again to FIGS. 1 and 3, it may be seen that the Z-belt lifting and stabilizing mechanism 10 is equipped with a drive mechanism 130 comprising a high torque and high rpm DC drive motor 132 coupled by a differential 134 or other motor linkage to and carried on the rear axle 42 with the carriage frame 34. The housing of the drive motor 132 and differential 134 is fixedly connected or coupled to the carriage frame 34 to prevent the drive motor 132 and differential 134 from rotating with the axle 42. The axle 42 may include a pickoff 135 to measure complete or partial revolutions of the axle 42, motor shaft of the drive motor 132, or drive wheel assemblies 44, or a similar timing mechanism may be incorporated to measure appropriate revolutions of the drive motor 132 or differential 134, the pickoff 135 preferably being contained within or connected to the housing for the drive motor 132 and differential 134.

In operation, the number and rate or angular velocity of revolutions of the axle 42 or drive motor 132 may be conveyed or read into a memory register within a CPU or other processing unit, and the number and rate of those revolutions compared to a chart of experimental readings or a mathematical formula or equation which relates the number of revolutions to the exact vertical linear registration or displacement of the carriage frame 34 relative to either a fixed point or the endpoint of the last vertical movement of the carriage frame 34, to determine a resultant displacement relative to the frame 12 or the fill tube 16. As such, output from the CPU can be fed directly to the drive motor 132 causing the axle 42 to rotate a desired number of revolutions in a selected direction (clockwise or counter-clockwise) at a desired angular velocity (RPM) to produce vertical movement of the carriage frame 34 in a selected vertical direction (up or down) at a desired linear velocity. This linear velocity may be expressed in terms of positive or negative units of length per unit of time, and the corresponding angular velocity may be expressed as a positive or negative number of revolutions or partial revolutions per unit of time. The linear distance which the carriage frame 34 moves will thereby be directly proportional to the number of revolutions or rotations of the drive wheel assemblies 46 and the corresponding axle 42, while the rate of ascent or descent of the carriage frame 34 will be directly proportional to the angular velocity of the drive wheel assemblies 46 and the corresponding axle 42. In situations in which the rate of ascent or descent is varied over the selected time interval during which the axle 42 and drive wheel assemblies 44 are being rotated, and the carriage assembly 34 is thereby being raised or lowered, the total resultant linear displacement D of the carriage frame 34 will be directly proportional to the total number of revolutions $N_r$ of the axle 42, drive wheel assemblies 46, or motor shaft and a constant $k_1$ relating the unit rotation of the axle 42 or drive wheel assemblies 44 to a predetermined unit linear displacement, and will further be directly proportional to the integral over the selected time interval between times $t_1$ and $t_2$ of the product of the angular velocity $v_a$ of the axle 42, drive wheel assemblies 44, or motor shaft and the time increment dt over which that angular velocity was maintained times the constant $k_2$ relating the unit rotation of the axle 42, drive wheel assemblies 44, or motor shaft to a predetermined unit linear displacement, thus producing the relationships:

$$D = k_1 N_r = k_2 \int_{t_1}^{t_2} v_a \cdot dt$$

The Z-belts 70 will generally be tensioned sufficiently that the Z-belts 70 cannot ride over the outer peripheral edges of the flanges 48 on either the drive wheel assemblies 44 or tensioning wheel assemblies 46, thereby preventing the Z-belts from becoming misaligned, however to prevent injury if a Z-belt 70 should become misaligned or break, a guard 136 may be placed on each side of the carriage frame 34 extending outwardly and downwardly to cover the outer edge of the outermost Z-belt 70. Further, in addition to the control provided by the CPU, a separate manual control 138 including a kill switch in addition to up/down or on/off/reverse switches should be incorporated into the apparatus.

Figure 12:
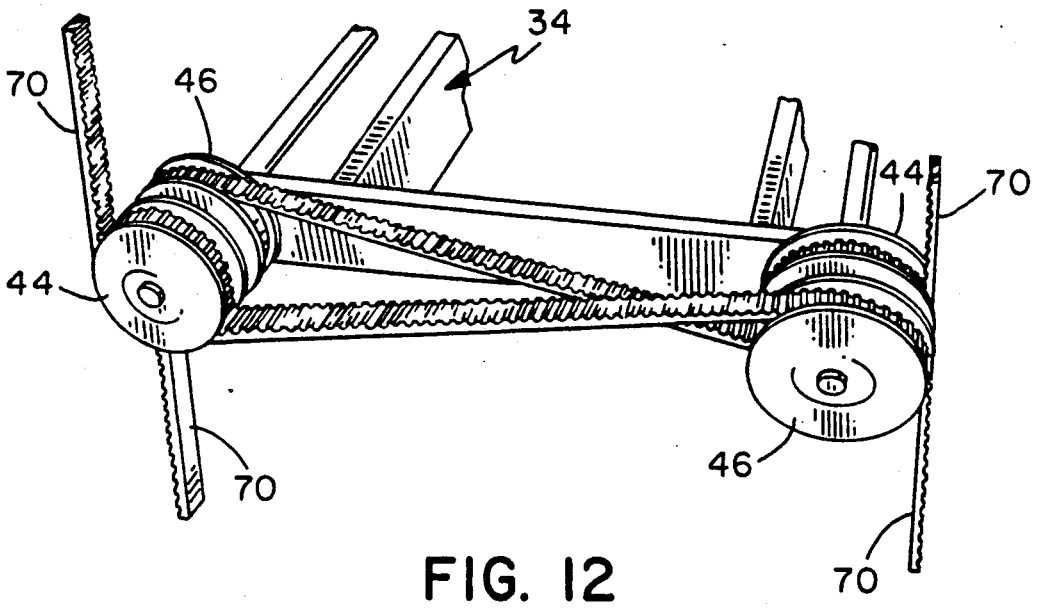
FIG. 12 is a partial perspective view of an alternate embodiment of the Z-belt lifting and stabilizing mechanism of this invention in which two drive wheels and two tensioning wheels are disposed on one side of the carriage frame, with the drive wheels on opposing ends of the carriage frame.
Figure 13:
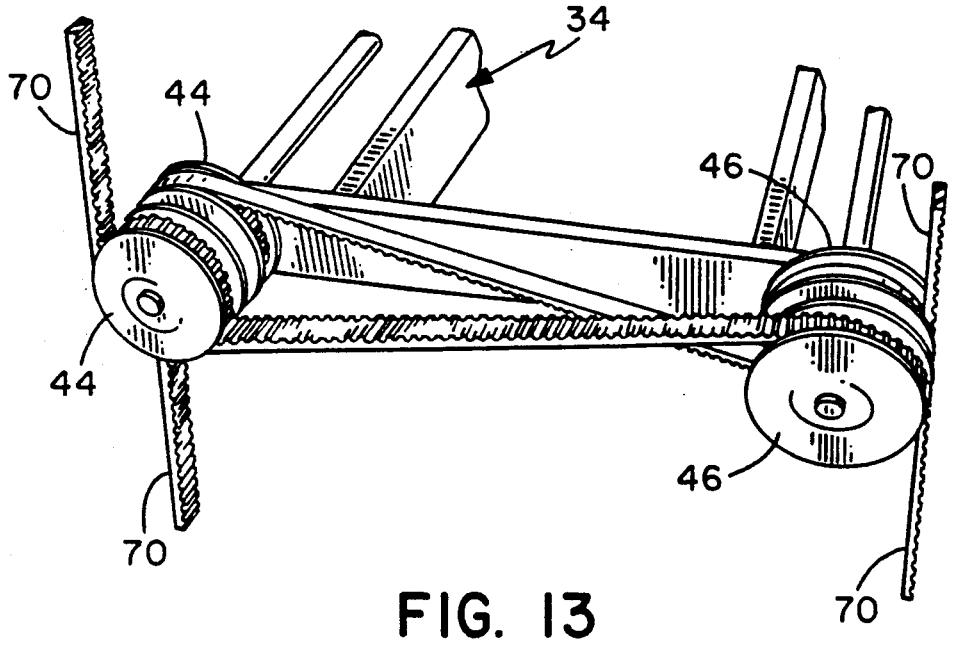
FIG. 13 is a partial perspective view of an alternate embodiment of the Z-belt lifting and stabilizing mechanism of this invention in which two drive wheels and two tensioning wheels are disposed on one side of the carriage frame.
Figure 14:
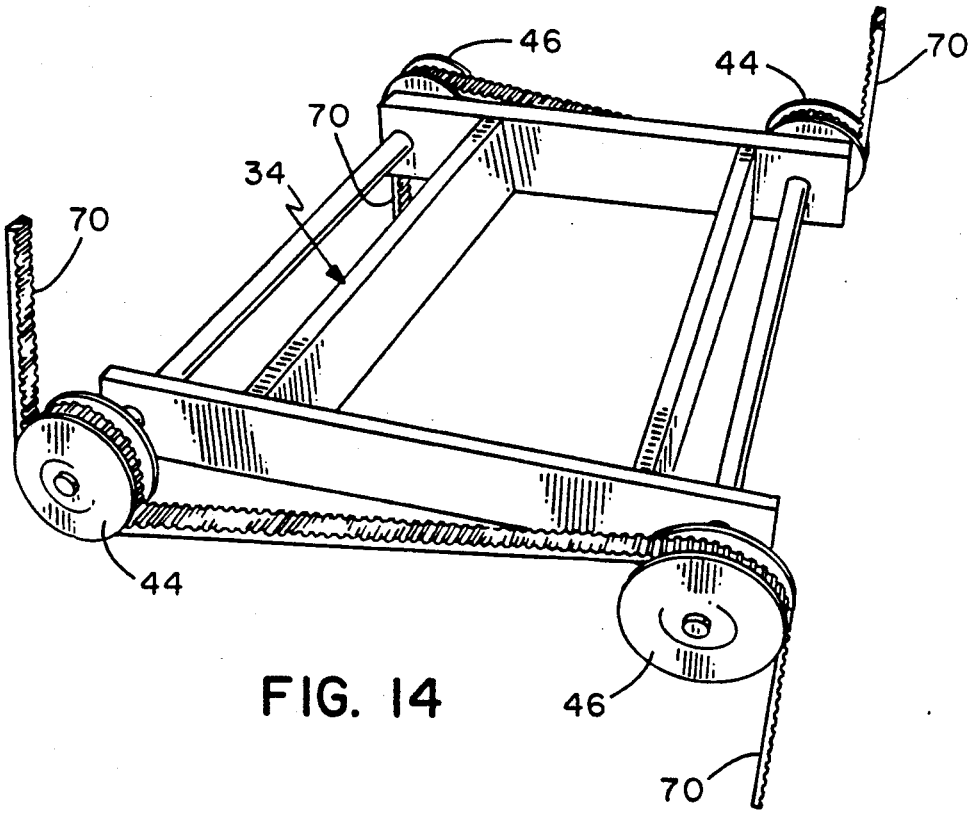
FIG. 14 is a partial perspective view of an alternate embodiment of the Z-belt lifting and stabilizing mechanism of this invention in which one drive wheel and one tensioning wheel is disposed on each side of the carriage frame, with the drive wheels on opposing ends of the carriage frame.
Figure 15:
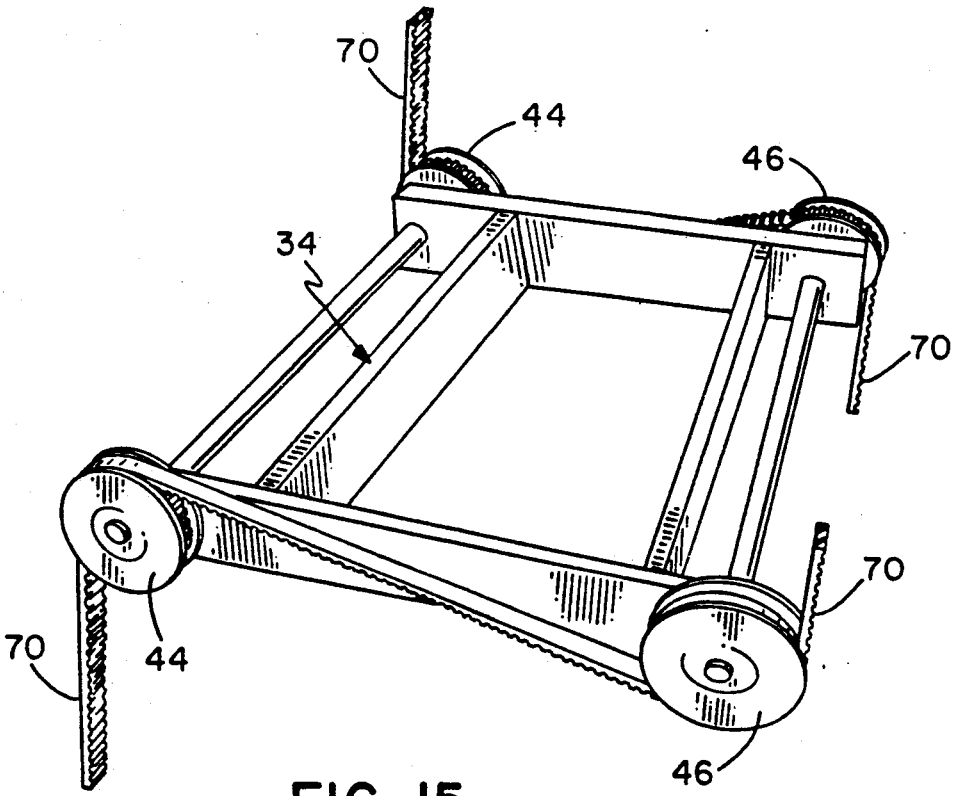
FIG. 15 is a partial perspective view of an alternate embodiment of the Z-belt lifting and stabilizing mechanism of this invention in which one drive wheel and one tensioning wheel is disposed on each side of the carriage frame, with the drive wheels disposed proximate to the same end of the carriage frame.

Referring to FIGS. 12–15, it may be seen that several other operable configurations of the drive wheel assemblies 44 and tensioning wheel assemblies 46 may be utilized in the Z-belt lifting and stabilizing mechanism 10. FIG. 12 shows an alternate configuration in which two drive wheels 44 and two tensioning wheels 46 are disposed on one side of the carriage frame 34, with the drive wheels 44 on opposing ends of the carriage frame 34. In such an embodiment, the Z-belts 70 may extend either upwardly or downwardly from the respective drive wheel assemblies 44, so long as one Z-belt 70 extends upwardly and one downwardly. FIG. 13 shows an alternate configuration in which two drive wheels 44 and two tensioning wheels 46 are disposed on the same side and the same end of the carriage frame 34, with the drive wheels 44 carried on the same axle 42 and aligned with the tensioning wheels 46 which are similarly carried on a single axle 42. FIG. 14 shows an alternate configuration in which one drive wheel 44 and one tensioning wheel 46 are disposed on each side of the carriage frame 34, with the drive wheels 44 being located proximate to opposing ends of the carriage frame 34. FIG. 15 shows an alternate configuration similar to that of FIG. 14 in which one drive wheel 44 and one tensioning wheel 46 are disposed on each side of the carriage frame 34, with the drive wheels 44 being disposed proximate to the same end of the carriage frame 34. As in each of the above configurations, the Z-belts 70 may extend either upwardly or downwardly from the respective drive wheel assemblies 44, so long as one Z-belt 70 extends upwardly and one downwardly from the respective drive wheels 44. It may be readily appreciated that while these various configurations and embodiments will prove suitable for some applications, the preferred embodiment of the Z-belt lifting and stabilizing mechanism 10 will generally provide superior stability for maintaining the predetermined horizontal orientation at high rates of linear movement along the vertical path and also be capable of supporting greater loads during operation without tilting.

It should also be understood that in many applications, the Z-belts 70, drive wheel assemblies 44, tensioning wheel assemblies 46, drive motor 132, and differential 134 will be the only components of the apparatus 10 which are subject to wear and the effects of wear on the components other than the Z-belts 70 will not be appreciable. Because the longitudinal tension on the Z-belts 70 can be adjusted, wear on the Z-belts 70 can be compensated for in order to maximize the life span of the Z-belts 70. The Z-belts 70 may still be changed at prescribed intervals, if desired, and it is unnecessary to disassembly the apparatus 10 or remove the apparatus 10 from the filling machine in order to change Z-belts 70 since the carriage frame 34 will remain suspended while individual Z-belts 70 are removed and replaced.

While the preferred embodiment of the above Z-belt lifting and stabilizing mechanism 10 has been described in detail above with reference to the attached drawing figures, it is understood that various changes and adaptations may be made in the Z-belt lifting and stabilizing mechanism 10 without departing from the spirit and scope of the appended claims.

What is claimed is:

1. A lifting and stabilizing apparatus for use in controllably raising and lowering a carriage relative to a frame along a vertical path having a top end and a bottom end, said carriage having a pair of opposing sides between which is measured a width and a pair of opposing ends between which is measured a length, said lifting and stabilizing apparatus comprising:

at least one drive wheel assembly is adapted for, said drive wheel assembly being rotatably mounted on at least one of the pair of opposing sides of the carriage proximate to one of the opposing ends thereof, said drive wheel assembly having a plurality of drive teeth, said drive wheel assembly having a top side and a bottom side generally opposing said top side;

a drive mechanism connected to said drive wheel assembly and capable of selectively rotating said drive wheel assembly at an angular velocity for a selected time interval;

at least one tensioning wheel assembly, said tensioning wheel assembly is adapted for being rotatably mounted on said one of the pair of opposing sides of the carriage to which said drive wheel assembly is mounted, said tensioning wheel assembly being mounted proximate to an end of the carriage opposing said one end to which said drive wheel assembly is proximate such that said drive wheel assembly is spaced apart from and generally aligned with and confronts said tensioning wheel assembly, said tensioning wheel assembly having a top side and a bottom side generally opposing said top side of said tensioning wheel assembly;

a pair of belts, each said belt being flexible and having a drive surface and a pair of opposing ends, said drive surface defining a multiplicity of belt teeth sized and shaped so as to mesh with and engage said drive teeth on said drive wheel assembly, each of said pair of belts having a longitudinal length measured between said pair of opposing ends thereof;

a plurality of clamping assemblies, each of said plurality of clamping assemblies is adapted for being connected to the frame, each of said plurality of clamping assemblies being capable of engagingly clamping one of said opposing ends of at least one of said pair of belts to maintain said opposing ends of said belts in a substantially fixed position relative to the frame and exert a longitudinal tension on said one of said pair of belts, each of said clamping assemblies being mounted at a height either proximate to or above the top end of the path or proximate to and below the bottom end of the path, such that a first belt of said pair of belts extends from one of said plurality of clamping assemblies generally adjacent the bottom end of the path upwardly and at least partially around said top side of said drive wheel assembly and toward said tensioning wheel assembly generally along the length of the carriage, said first belt further extending at least partially around said bottom side of said tensioning wheel assembly and upwardly to one of said plurality of clamping assemblies generally adjacent to the top of the path, and such that a second belt of said pair of belts extends from one of said plurality of clamping assemblies generally adjacent the top end of the path downwardly and at least partially around said bottom side of said drive wheel assembly and toward said tensioning wheel assembly generally along the length of the carriage, said second belt further extending at least partially around said top side of said tensioning wheel assembly and downwardly to on of said plurality of clamping assemblies generally adjacent to the bottom of the path, whereby the drive mechanism may be selectively actuated to cause the drive wheel assembly to rotate a number of revolutions, the rotation of the drive wheel assembly causing the drive wheel assembly to move along and relative to both the drive surface of the first belt and the drive surface of the second belt thereby causing the carriage to be raised or lowered a linear distance along the path, said linear distance being directly proportional to said number of revolutions of the drive wheel assembly, the first belt and the second belt being maintained under sufficient longitudinal tension by the clamping assemblies, the drive wheel assembly, and the tensioning wheel such that the first belt and the second belt hold and constrain the carriage in a predetermined horizontal orientation.

2. The lifting and stabilizing apparatus of claim 1 wherein the drive wheel is connected to and rotatably carried on an axle.

3. The lifting and stabilizing apparatus of claim 2 further comprising:

means for counting a number of revolutions of the axle in a particular angular direction; and a processing mechanism capable of reading said number of revolutions of the axle in said particular direction and determining a linear displacement of the carriage relative to a reference point using a formula relating said linear displacement relative to said reference point with said number of revolutions of the axle and said particular angular direction.

4. The lifting and stabilizing apparatus of claim 2 wherein the drive mechanism includes a motor and a drive linkage connecting said motor to the axle, said motor and said drive linkage being mounted to and carried with the axle when the carriage is raised or lowered along the path.

5. The lifting and stabilizing apparatus of claim 1 wherein the plurality of clamping assemblies each comprise:

a backing plate;

a clamping plate opposing said backing plate and initially spaced-apart therefrom, the one of the opposing ends of the one of the pair of belts being engagingly clamped by the clamping assembly being disposed between said clamping plate and said backing plate; and means for selectively and forcibly urging said clamping plate toward said backing plate and into clamping and engaging contact with the one of the pair of belts.

6. The lifting and stabilizing apparatus of claim wherein the drive surface of the one of the pair of belts is oriented facing and confronting the backing plate, and wherein the backing which confronts the drive surface of the one of the pair of belts defines a plurality of clamping teeth which are sized and shaped to mesh with and engage the belt teeth of the drive surface of the one of the pair of belts.

7. The lifting and stabilizing apparatus of claim 5 wherein the drive surface of one of the pair of belts is oriented facing and confronting the clamping plate, and wherein the clamping plate which confronts the drive surface of the one of the pair of belts defines a plurality of clamping teeth which are sized and shaped to mesh with and engage the belt teeth of the drive surface of the one of the pair of belts.

8. The lifting and stabilizing apparatus of claim 1 wherein the plurality of clamping assemblies each comprise:

a tension adjusting means for selectively adjusting the longitudinal tension which a selected clamping assembly exerts on the one of the pair of belts which said selected clamping assembly is engagingly clamping.

9. The lifting and stabilizing apparatus of claim 8 wherein the tension adjusting means of the clamping assemblies may further be used to selectively adjust the predetermined horizontal orientation of the carriage.

10. The lifting and stabilizing apparatus of claim 8 wherein the selected clamping assembly includes a backing plate and the tension adjusting means comprises:

an extension bracket which is adapted for being fixedly connected to the frame; and a tensioning fastener movably connected to said extension bracket and fixedly connected to the backing plate, said tensioning fastener being selectively movable relative to said extension bracket by rotation of said tensioning fastener in a first direction or a second direction, rotation of said tensioning fastener in said first direction increasing said longitudinal tension and rotation of said tensioning fastener in said second direction decreasing said longitudinal tension, whereby the tensioning fastener may be selectively moved relative to the extension bracket to selectively increase or decrease the longitudinal tension by rotating the tensioning fastener in the first or the second direction.

11. The lifting and stabilizing apparatus of claim 1 wherein the drive wheel assembly comprises a first drive wheel and a second drive wheel, said first drive wheel being mounted to rotate in unison with said second drive wheel at the angular velocity.

12. A lifting and stabilizing apparatus for use in controllably raising and lowering a carriage relative to a frame along a vertical path having a top end and a bottom end, said carriage having a pair of opposing sides between which is measured a width and a pair of opposing ends between which is measured a length, said lifting and stabilizing apparatus comprising:

a first drive wheel, said first drive wheel is adapted for being rotatably mounted on a first side of the pair of opposing sides of the carriage proximate to a first one of the opposing ends thereof, said first drive wheel having a plurality of drive teeth, said first drive wheel having a top side and a bottom side generally opposing said top side;

a second drive wheel, said second drive wheel is adapted for being rotatably mounted on said first side of the carriage proximate to said first end thereof, said second drive wheel having a plurality of drive teeth, said second drive wheel having a top side and a bottom side generally opposing said top side;

a drive mechanism, said drive mechanism being connected to at least said first drive wheel and capable of selectively rotating at least said first drive wheel at an angular velocity for a selected time interval;

at least one tensioning wheel, said tensioning wheel is adapted for being rotatably mounted on said first side of the carriage, said tensioning wheel being mounted proximate to a second end of the carriage opposing said first such that said first drive wheel and said second drive wheel are spaced apart from and generally aligned with and confront said tensioning wheel, said tensioning wheel having a top side and a bottom side generally opposing said top side of said tensioning wheel;

a pair of belts, each said belt being flexible and having a drive surface which is aligned with one of said first drive wheel or said second drive wheel and a pair of opposing ends, said drive surface of each said belt defining a multiplicity of belt teeth sized and shaped so as to mesh with and engage said drive teeth on one of said first drive wheel and said second drive wheel, each of said pair of belts having a longitudinal length measured between said pair of opposing ends thereof;

a plurality of clamping assemblies, each of said plurality of clamping assemblies is adapted for being connected to the frame, each of said plurality of clamping assemblies being capable of engagingly clamping one of said opposing ends of at least one of said pair of belts to maintain said opposing ends of said belts in a substantially fixed position relative to the frame, each of said clamping assemblies being mounted at a height either proximate to or above the top end of the path or proximate to and below the bottom end of the path, such that a first belt of said pair of belts extends from one of said plurality of clamping assemblies generally adjacent the bottom end of the path upwardly and at least partially around said top side of said first drive wheel and toward said tensioning wheel generally along the length of the carriage, said first belt further extending at least partially around said bottom side of said tensioning wheel and upwardly to one of said plurality of clamping assemblies generally adjacent to the top of the path, and such that a second belt of said pair of belts extends from one of said plurality of clamping assemblies generally adjacent the top end of the path downwardly and at least partially around said bottom side of said second drive wheel and toward said tensioning wheel generally along the length of the carriage, said second belt further extending at least partially around said top side of said tensioning wheel and downwardly to one of said plurality of clamping assemblies generally adjacent to the bottom of the path, whereby the drive mechanism may be selectively actuated to cause at least the first drive wheel to rotate a number of revolutions, the rotation of the first drive wheel causing the first drive wheel to move along and relative to the drive surface of the first belt and the second drive wheel to move along and relative to the drive surface of the second belt, thereby causing the carriage to be raised or lowered a linear distance along the path, said linear distance being directly proportional to said number of revolutions of the first drive wheel, the first belt and the second belt being maintained under sufficient longitudinal tension by the clamping assemblies, the first drive wheel and the second drive wheel, and the tensioning wheel such that the first belt and the second belt hold and constrain the carriage in a predetermined horizontal orientation.

13. The lifting and stabilizing apparatus of claim 12 wherein the drive mechanism is operatively connected to both the first drive wheel and the second drive wheel, the drive mechanism selectively causing both the first drive wheel and the second drive wheel to rotate to raise or lower the carriage.

14. The lifting and stabilizing apparatus of claim 12 wherein the first drive wheel is connected to and rotatably carried on an axle and the second drive wheel is connected to and rotatably carried on said axle.

15. The lifting and stabilizing apparatus of claim 14 further comprising:

a pickoff mechanism for counting a number of revolutions of the axle in a particular angular direction; and a processing mechanism capable of reading said number of revolutions of the axle in said particular direction and determining a linear displacement of the carriage relative to a reference point using a formula relating said linear displacement relative to said reference point with said number of revolutions of the axle and said particular angular direction.

16. The lifting and stabilizing apparatus of claim 14 wherein the drive mechanism includes a motor and a drive linkage connecting said motor to the axle, said motor and said drive linkage being mounted to and carried with the axle when the carriage is raised or lowered along the path.

17. The lifting and stabilizing apparatus of claim 12 wherein the plurality of clamping assemblies each comprise a backing plate;

a clamping plate opposing said backing plate and initially spaced-apart therefrom, the one of the opposing ends of the one of the pair of belts being engagingly clamped by the clamping assembly being disposed between said clamping plate and said backing plate; and means for selectively and forcibly urging said clamping plate toward said backing plate and into clamping and engaging contact with the one of the pair of belts.

18. The lifting and stabilizing apparatus of claim 17 wherein the drive surface of the one of the pair of belts is oriented facing and confronting the backing plate, and wherein the backing plate or the clamping plate which confronts the drive surface of the one of the pair of belts defines a plurality of clamping teeth which are sized and shaped to mesh with and engage the belt teeth of the drive surface of the one of the pair of belts.

19. The lifting and stabilizing apparatus of claim 17 wherein the drive surface of one of the pair of belts is oriented facing and confronting the clamping plate, and wherein the clamping plate which confronts the drive surface of the one of the pair of belts defines a plurality of clamping teeth which are sized and shaped to mesh with and engage the belt teeth of the drive surface of the one of the pair of belts.

20. The lifting and stabilizing apparatus of claim 12 wherein the plurality of clamping assemblies each comprise:

a tension adjusting means for selectively adjusting the longitudinal tension which a selected clamping assembly exerts on the one of the pair of belts which said selected clamping assembly is engagingly clamping.

21. The lifting and stabilizing apparatus of claim 20 wherein the tension adjusting means of the clamping assemblies may further be used to selectively adjust the predetermined horizontal orientation of the carriage.

22. The lifting and stabilizing apparatus of claim 20 wherein the selected clamping assembly includes a backing plate and the tension adjusting means comprises:

an extension bracket which is adapted for being fixedly connected to the frame; and a tensioning fastener movably connected to said extension bracket and fixedly connected to the backing plate, said tensioning fastener being selectively movable relative to said extension bracket by rotation of said tensioning fastener in a first direction or a second direction, rotation of said tensioning fastener in said first direction increasing said longitudinal tension and rotation of said tensioning fastener in said second direction decreasing said longitudinal tension, whereby the tensioning fastener may be selectively moved relative to the extension bracket to selectively increase or decrease the longitudinal tension by rotating the tensioning fastener in the first or the second direction.

23. A lifting and stabilizing apparatus for use in controllably raising and lowering a carriage relative to a frame along a vertical path having a top end and a bottom end, said carriage having a pair of opposing sides between which is measured a width and a pair of opposing ends between which is measured a length, said lifting and stabilizing apparatus comprising:

a first drive wheel, said first drive wheel is adapted for being rotatably mounted on a first side of the pair of opposing sides of the carriage, said first drive wheel having a plurality of drive teeth, said first drive wheel having a top side and a bottom side generally opposing said top side;

a second drive wheel, said second drive wheel is adapted for being rotatably mounted on said second side of the carriage, said second drive wheel having a plurality of drive teeth, said second drive wheel having a top side and a bottom side generally opposing said top side;

a drive mechanism, said drive mechanism being connected to at least said first drive wheel and capable of selectively rotating at least said first drive wheel at an angular velocity for a selected time interval;

a first tensioning wheel, said first tensioning wheel is adapted for being rotatably mounted on said first side of the carriage such that said first drive wheel is spaced apart from and generally aligned with and confronting said first tensioning wheel, said first tensioning wheel having a top side and a bottom side generally opposing said top side of said tensioning wheel;

a second tensioning wheel, said second tensioning wheel is adapted for being rotatably mounted on said second side of the carriage such that said first drive wheel is spaced apart from and generally aligned with and confronting said first tensioning wheel, said first tensioning wheel having a top side and a bottom side generally opposing said top side of said tensioning wheel;

a pair of belts, each said belt being flexible and having a drive surface which is aligned with one of said first drive wheel or said second drive wheel and a pair of opposing ends, said drive surface of each said belt defining a multiplicity of belt teeth sized and shaped so as to mesh with and engage said drive teeth on one of said first drive wheel and said second drive wheel, each of said pair of belts having a longitudinal length measured between said pair of opposing ends thereof;

a plurality of clamping assemblies, each of said plurality of clamping assemblies is adapted for being connected to the frame, each of said plurality of clamping assemblies being capable of engagingly clamping one of said opposing ends of at least one of said pair of belts to maintain said opposing ends of said belts in a substantially fixed position relative to the frame, each of said clamping assemblies being mounted at a height either proximate to or above the top end of the path or proximate to and below the bottom end of the path, such that a first belt of said pair of belts extends from one of said plurality of clamping assemblies generally adjacent the bottom end of the path upwardly and at least partially around said top side of said first drive wheel and toward said first tensioning wheel generally along the length of the carriage, said first belt further extending at least partially around said bottom side of said first tensioning wheel and upwardly to one of said plurality of clamping assemblies generally adjacent to the top of the path, and such that a second belt of said pair of belts extends from one of said plurality of clamping assemblies generally adjacent the top end of the path downwardly and at least partially around said bottom side of said second drive wheel and toward said second tensioning wheel generally along the length of the carriage, said second belt further extending at least partially around said top side of said second tensioning wheel and downwardly to one of said plurality of clamping assemblies generally adjacent to the bottom of the path, whereby the drive mechanism may be selectively actuated to cause at least the first drive wheel to rotate a number of revolutions, the rotation of the first drive wheel causing the first drive wheel to move along and relative to the drive surface of the first belt and the second drive wheel to move along and relative to the drive surface of the second belt, thereby causing the carriage to be raised or lowered a linear distance along the path, said linear distance being directly proportional to said number of revolutions of the first drive wheel or the second drive wheel, the first belt and the second belt being maintained under sufficient longitudinal tension by the clamping assemblies, the first drive wheel and the second drive wheel, the first tensioning wheel, and the second tensioning wheel such that the first belt and the second belt hold and constrain the carriage in a predetermined horizontal orientation.

24. The lifting and stabilizing apparatus of claim 23 wherein the first drive wheel is positioned proximate to a first end of the pair of opposing ends of the carriage, the first tensioning wheel is positioned proximate to a second end of the pair of opposing ends of the carriage, the second drive wheel is positioned proximate to said first end of the carriage, and the second tensioning wheel is positioned proximate to said second end of the carriage.

25. The lifting and stabilizing apparatus of claim 23 wherein the drive mechanism is operatively connected to both the first drive wheel and the second drive wheel, the drive mechanism selectively causing both the first drive wheel and the second drive wheel to rotate to raise or lower the carriage.

26. The lifting and stabilizing apparatus of claim 23 wherein the first drive wheel is connected to and rotatably carried on an axle and the second drive wheel is connected to and rotatably carried on said axle.

27. The lifting and stabilizing apparatus of claim 26 further comprising:

a pickoff mechanism for counting a number of revolutions of the axle in a particular angular direction; and a processing mechanism capable of reading said number of revolutions of the axle in said particular direction and determining a linear displacement of the carriage relative to a reference point using a formula relating said linear displacement relative to said reference point with said number of revolutions of the axle and said particular angular direction.

28. The lifting and stabilizing apparatus of claim 26 wherein the drive mechanism includes a motor and a drive linkage connecting said motor to the axle, said motor and said drive linkage being mounted to and carried with the axle when the carriage is raised or lowered along the path.

29. The lifting and stabilizing apparatus of claim 23 wherein the plurality of clamping assemblies each comprise:

a backing plate;

a clamping plate opposing said backing plate and initially spaced-apart therefrom, the one of the opposing ends of the one of the pair of belts being engagingly clamped by the clamping assembly being disposed between said clamping plate and said backing plate; and means for selectively and forcibly urging said clamping plate toward said backing plate and into clamping and engaging contact with the one of the pair of belts.

30. The lifting and stabilizing apparatus of claim 29 wherein the drive surface of the one of the pair of belts is oriented facing and confronting the backing plate, and wherein the backing plate which confronts the drive surface of the one of the pair of belts defines a plurality of clamping teeth which are sized and shaped to mesh with and engage the belt teeth of the drive surface of the one of the pair of belts.

31. The lifting and stabilizing apparatus of claim 29 wherein the drive surface of one of the pair of belts is oriented facing and confronting the clamping plate, and wherein the clamping plate which confronts the drive surface of the one of the pair of belts defines a plurality of clamping teeth which are sized and shaped to mesh with and engage the belt teeth of the drive surface of the one of the pair of belts.

32. The lifting and stabilizing apparatus of claim 23 wherein the plurality of clamping assemblies each comprise:

a tension adjusting means for selectively adjusting the longitudinal tension which a selected clamping assembly exerts on the one of the pair of belts which said selected clamping assembly is engagingly clamping.

33. The lifting and stabilizing apparatus of claim 32 wherein the tension adjusting means of the clamping assemblies may further be used to selectively adjust the predetermined horizontal orientation of the carriage.

34. The lifting and stabilizing apparatus of claim 32 wherein the selected clamping assembly includes a backing plate and the tension adjusting means comprises:

an extension bracket which is adapted for being fixedly connected to the frame; and a tensioning fastener movably connected to said extension bracket and fixedly connected to the backing plate, said tensioning fastener being selectively movable relative to said extension bracket by rotation of said tensioning fastener in a first direction or a second direction, rotation of said tensioning fastener in said first direction increasing said longitudinal tension and rotation of said tensioning fastener in said second direction decreasing said longitudinal tension, whereby the tensioning fastener may be selectively moved relative to the extension bracket to selectively increase or decrease the longitudinal tension by rotating the tensioning fastener in the first or the second direction.

35. A lifting and stabilizing apparatus for use in controllably raising and lowering a carriage relative to a frame along a vertical path having a top end and a bottom end, said carriage having a pair of opposing sides between which is measured a width and a pair of opposing ends between which is measured a length, said lifting and stabilizing apparatus comprising:

a first drive wheel, said first drive wheel is adapted for being rotatably mounted on a first side of the pair of opposing sides of the carriage, said first drive wheel having a plurality of drive teeth, said first drive wheel having a top side and a bottom side generally opposing said top side;

a second drive wheel, said second drive wheel is adapted for being rotatably mounted on said first side of the carriage, said second drive wheel having a plurality of drive teeth, said second drive wheel having a top side and a bottom side generally opposing said top side;

a third drive wheel, said third drive wheel is adapted for being rotatably mounted on a second side of the pair of opposing sides of the carriage, said third drive wheel having a plurality of drive teeth, said third drive wheel having a top side and a bottom side generally opposing said top side;

a fourth drive wheel, said fourth drive wheel is adapted for being rotatably mounted on said second side of the pair of opposing sides of the carriage, said fourth drive wheel having a plurality of drive teeth, said fourth drive wheel having a top side and a bottom side generally opposing said top side;

a drive mechanism, said drive mechanism being connected to at least said first drive wheel, and capable of selectively rotating at least said first drive wheel at an angular velocity for a selected time interval;

at least one first tensioning wheel, said first tensioning wheel is adapted for being rotatably mounted on said first side of the carriage such that said first drive wheel and said second drive wheel are spaced apart from and generally aligned with and confronting said first tensioning wheel, said first tensioning wheel having a top side and a bottom side generally opposing said top side of said tensioning wheel;

at least one second tensioning wheel, said second tensioning wheel is adapted for being rotatably mounted on said second side of the carriage such that said third drive wheel and said fourth drive wheel are spaced apart from and generally aligned with and confronting said second tensioning wheel, said first tensioning wheel having a top side and a bottom side generally opposing said top side of said tensioning wheel;

a plurality of belts, each of said plurality of belts being flexible and having a drive surface which is aligned with one of said first drive wheel or said second drive wheel and a pair of opposing ends, said drive surface of each of said plurality of belts defining a multiplicity of belt teeth sized and shaped so as to mesh with and engage said drive teeth on one of said first drive wheel, said second drive wheel, said third drive wheel, and said fourth drive wheel, each of said plurality of belts having a longitudinal length measured between said pair of opposing ends thereof;

a plurality of clamping assemblies, each of said plurality of clamping assemblies is adapted for being connected to the frame, each of said plurality of clamping assemblies being capable of engagingly clamping one of said opposing ends of at least one of said plurality of belts to maintain said opposing ends of said plurality of belts in a substantially fixed position relative to the frame, each of said clamping assemblies being mounted at a height either proximate to or above the top end of the path or proximate to and below the bottom end of the path, such that a first belt of said plurality of belts extends from one of said plurality of clamping assemblies generally adjacent the bottom end of the path upwardly and at least partially around said top side of said first drive wheel and toward said first tensioning wheel generally along the length of the carriage, said first belt further extending at least partially around said bottom side of said first tensioning wheel and upwardly to one of said plurality of clamping assemblies generally adjacent to the top of the path, and such that a second belt of said plurality of belts extends from one of said plurality of clamping assemblies generally adjacent the top end of the path downwardly and at least partially around said bottom side of said second drive wheel and toward said first tensioning wheel generally along the length of the carriage, said second belt further extending at least partially around said top side of said first tensioning wheel and downwardly to one of said plurality of clamping assemblies generally adjacent to the bottom of the path, and such that a third belt of said plurality of belts extends from one of said plurality of clamping assemblies generally adjacent the bottom end of the path upwardly and at least partially around said top side of said third drive wheel and toward said second tensioning wheel generally along the length of the carriage, said third belt further extending at least partially around said bottom side of said second tensioning wheel and upwardly to one of said plurality of clamping assemblies generally adjacent to the top of the path, and such that a fourth belt of said plurality of belts extends from one of said plurality of clamping assemblies generally adjacent the top end of the path downwardly and at least partially around said bottom side of said fourth drive wheel and toward said second tensioning wheel generally along the length of the carriage, said fourth belt further extending at least partially around said top side of said second tensioning wheel and downwardly to one of said plurality of clamping assemblies generally adjacent to the bottom of the path, whereby the drive mechanism may be selectively actuated to cause at least the first drive wheel to rotate a number of revolutions, the rotation of the first drive wheel causing the first drive wheel to move along and relative to the drive surface of the first belt, the second drive wheel to move along and relative to the drive surface of the second belt, the third drive wheel to move along and relative to the drive surface of the third belt, and the fourth drive wheel to move along and relative to the drive surface of the fourth belt, thereby causing the carriage to be raised or lowered a linear distance along the path, said linear distance being directly proportional to said number of revolutions of the first drive wheel, the second drive wheel, the third drive wheel, and the fourth drive wheel, the first belt, the second belt, the third belt, and the fourth belt being maintained under sufficient longitudinal tension by the clamping assemblies, the first drive wheel, the second drive wheel, the third drive wheel, the fourth drive wheel, the first tensioning wheel, and the second tensioning wheel such that the first belt, the second belt, the third belt, and the fourth belt hold and constrain the carriage in a predetermined horizontal orientation.

36. The lifting and stabilizing apparatus of claim 35 wherein the first drive wheel and the second drive wheel are positioned proximate to a first end of the pair of opposing ends of the carriage, the first tensioning wheel is positioned proximate to a second end of the pair of opposing ends of the carriage, the third drive wheel and the fourth drive wheel are positioned proximate to said first end of the carriage, and the second tensioning wheel is positioned proximate to said second end of the carriage.

37. The lifting and stabilizing apparatus of claim 35 wherein the drive mechanism is operatively connected to both the first drive wheel and the second drive wheel, the drive mechanism selectively causing both the first drive wheel and the second drive wheel to rotate to raise or lower the carriage.

38. The lifting and stabilizing apparatus of claim 37 wherein the first drive wheel is connected to and rotatably carried on an axle and the second drive wheel is connected to and rotatably carried on said axle.

39. The lifting and stabilizing apparatus of claim 38 further comprising:

a pickoff mechanism for counting a number of revolutions of the axle in a particular angular direction; and a processing mechanism capable of reading said number of revolutions of the axle in said particular direction and determining a linear displacement of the carriage relative to a reference point using a formula relating said linear displacement relative to said reference point with said number of revolutions of the axle and said particular angular direction.

40. The lifting and stabilizing apparatus of claim 35 wherein the drive mechanism includes a motor and a drive linkage connecting said motor to the axle, said motor and said drive linkage being mounted to and carried with the axle when the carriage is raised or lowered along the path.

41. The lifting and stabilizing apparatus of claim 35 wherein the plurality of clamping assemblies each comprise:

a backing plate;

a clamping plate opposing said backing plate and initially spaced-apart therefrom, the one of the opposing ends of the one of the plurality of belts being engagingly clamped by the clamping assembly being disposed between said clamping plate and said backing plate; and means for selectively and forcibly urging said clamping plate toward said backing plate and into clamping and engaging contact with the on of the plurality of belts.

42. The lifting and stabilizing apparatus of claim 41 wherein the drive surface of the one of the plurality of belts is oriented facing and confronting the backing plate, and wherein the backing plate which confronts the drive surface of the one of the plurality of belts defines a plurality of clamping teeth which are sized and shaped to mesh with and engage the belt teeth of the drive surface of the one of the plurality of belts.

43. The lifting and stabilizing apparatus of claim 41 wherein the drive surface of one of the pair of belts is oriented facing and confronting the clamping plate, and wherein the clamping plate which confronts the drive surface of the one of the pair of belts defines a plurality of clamping teeth which are sized and shaped to mesh with and engage the belt teeth of the drive surface of the one of the pair of belts.

44. The lifting and stabilizing apparatus of claim 35 wherein the plurality of clamping assemblies each comprise:

a tension adjusting means for selectively adjusting the longitudinal tension which a selected clamping assembly exerts on the one of the plurality of belts which said selected clamping assembly is engagingly clamping.

45. The lifting and stabilizing apparatus of claim 44 wherein the tension adjusting means of the clamping assemblies may further be used to selectively adjust the predetermined horizontal orientation of the carriage.

46. The lifting and stabilizing apparatus of claim 44 wherein the selected clamping assembly includes a backing plate and the tension adjusting means comprises:

an extension bracket which is adapted for being fixedly connected to the frame; and a tensioning fastener movably connected to said extension bracket and fixedly connected to the backing plate, said tensioning fastener being selectively movable relative to said extension bracket by rotation of said tensioning fastener in a first direction or a second direction, rotation of said tensioning fastener in said first direction increasing said longitudinal tension and rotation of said tensioning fastener in said second direction decreasing said longitudinal tension, whereby the tensioning fastener may be selectively moved relative to the extension bracket to selectively increase or decrease the longitudinal tension by rotating the tensioning fastener in the first or the second direction.

* * * * *

UNITED STATES PATENT AND TRADEMARK OFFICE

CERTIFICATE OF CORRECTION

PATENT NO. : 5,191,920

DATED : March 9, 1993

INVENTOR(S) : Harold R. McGregor

It is certified that error appears in the above-identified patent and that said Letters Patent is hereby corrected as shown below:

In col 1, ln 13, insert the letter --n-- at the end of the word "know".

In col 1, ln 61, insert the letter --r-- after the "e" in the word "Vetical".

In col 2, ln 36, insert the letter --r-- after the "o" before "displacement".

In col 2, ln 51, delete one "is".

In col 4, ln 34, insert the letter --f-- after "o" following the word "each".

In col 4, ln 55, insert the letter --l-- at the end of the word "norma".

In col 5, ln 34, insert the letter --o-- after "t" following the word "adjacent".

In col 6, ln 49, delete "88" after the word "the".

In col 7, ln 54, delete one "the".

In claim 1, col 11, ln 47, insert the letter --e-- at the end of the word "on".

In claim 6, col 12, ln 33, insert the number --5-- after the word "claim".

In claim 18, col 15, ln 24, delete "or the clamping plate".

UNITED STATES PATENT AND TRADEMARK OFFICE

CERTIFICATE OF CORRECTION

PATENT NO. : 5,191,920

DATED : March 9, 1993

INVENTOR(S) : Harold R. McGregor

It is certified that error appears in the above-identified patent and that said Letters Patent is hereby corrected as shown below:

In claim 40, col 21, ln 42, delete "35" and substitute --38-- therefor.

In claim 41, col 22, ln 5, insert the letter --e-- at the end of the word "on".

Signed and Sealed this

Eighth Day of February, 1994

Bruce Lehman

*Attest:*

BRUCE LEHMAN

*Attesting Officer*

*Commissioner of Patents and Trademarks*